United States Patent [19]

Perreault et al.

[11] Patent Number: 5,046,699

[45] Date of Patent: Sep. 10, 1991

[54] ANCHORING DEVICE FOR POST

[76] Inventors: Gilles R. Perreault, 88, rue Principale, Frampton, Quebec, Canada, G0R 1M0; Pierre P. Gagnon, 905, de Bourgchemin, Terrebonne, Quebec, Canada, J6X 1X6

[21] Appl. No.: 594,936

[22] Filed: Oct. 10, 1990

[51] Int. Cl.[5] ..... A45B 9/00; A45B 25/16; A45F 3/44

[52] U.S. Cl. ..... 248/533; 248/156; 248/530; 248/545; 52/157; 135/16

[58] Field of Search ..... 52/155, 157, 165; 248/156, 530, 532, 533, 545; 135/20 R, 16, 27, 40; 47/40.5

[56] References Cited

U.S. PATENT DOCUMENTS

| | | | |
|---|---|---|---|
| 383,296 | 5/1888 | Husselman | 52/165 |
| 891,448 | 6/1908 | Snider | 52/165 |
| 2,211,283 | 8/1940 | Mercer | 52/165 |
| 2,643,843 | 6/1953 | Brown | 52/157 |

*Primary Examiner*—Richard E. Chilcot, Jr.
*Assistant Examiner*—Robert Canfield
*Attorney, Agent, or Firm*—Roland L. Morneau

[57] ABSTRACT

An anchoring device for securing a post such as a beach umbrella into the ground comprising a hollow tubular member for vertically holding the post, a screw member at the lower end of the tubular member, a pair of laterally extending lever arms at the upper end of the tubular member for twisting the screw member and the tubular member and driving both into the ground.

4 Claims, 4 Drawing Sheets

ANCHORING DEVICE FOR POST

BACKGROUND OF THE INVENTION

1. Field of the Invention

The present invention is directed to an anchoring device for securing a post to the ground, and in particular, for securing beach umbrella on the beach for preventing the latter form being blown up by the wind. The device is provided with a screw member at the lower end and a pair of handles extending laterally for twisting the screw member into the ground.

2. Prior Art

A search performed by the applicant at the Canadian Patent Office among Canadian patents has failed to reveal any pertinent reference.

SUMMARY OF THE INVENTION

An anchoring device for securing a post such as a beach umbrella into the ground comprising a hollow tubular member for vertically holding the post, a screw member at the lower end of the tubular member, a pair of laterally extending lever arms at the upper end of the tubular member for twisting the screw member and the tubular member and driving both into the ground. Another embodiment of the invention comprises a pair of handles and a screw member separately fixed to the post. In both cases, the handles are pivotally mounted and adapted to tighten the post in the tubular member.

DETAILED DESCRIPTION OF THE INVENTION

Figure 1:
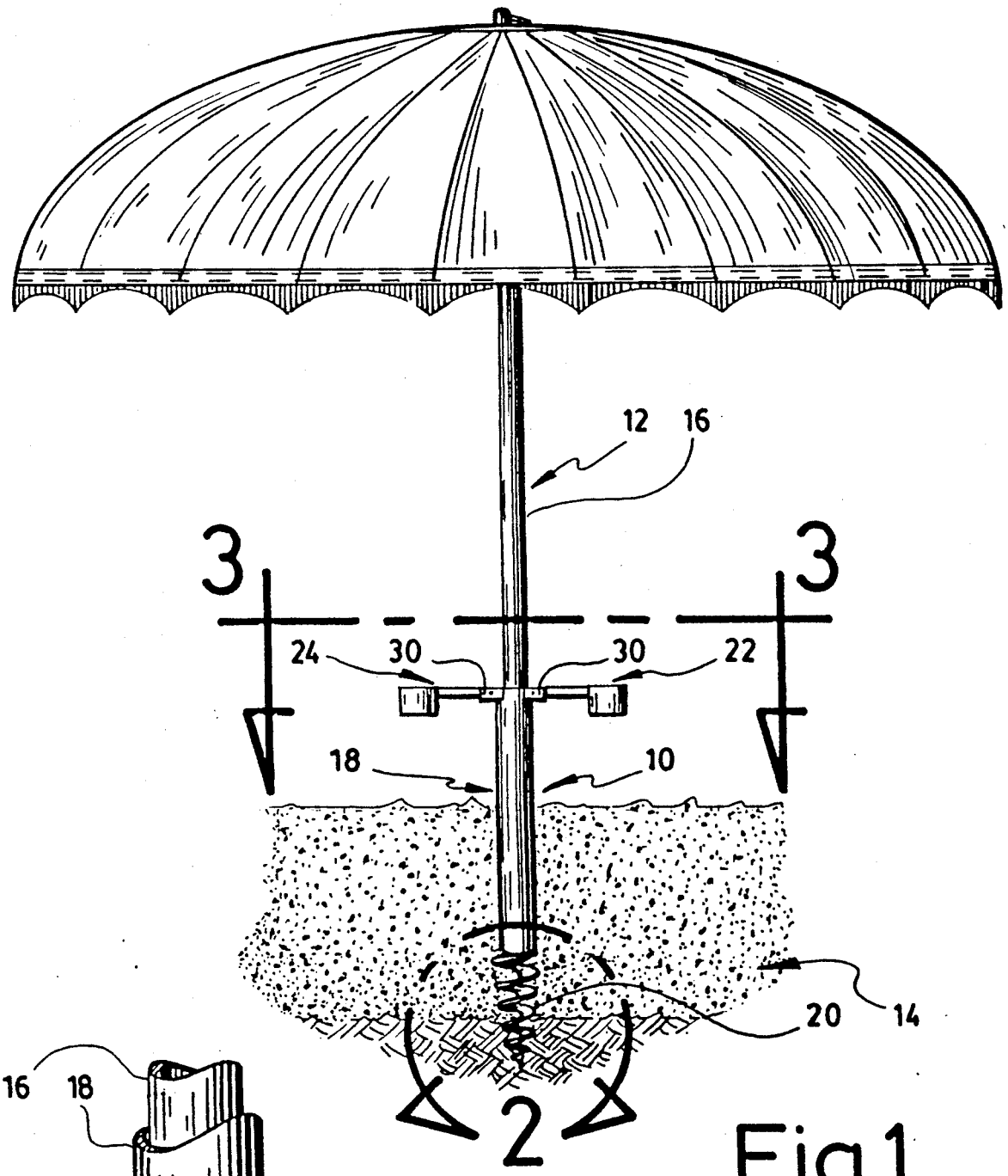
FIG. 1 is a side view of an anchoring device according to the invention which is secured into the ground and which supports a beach umbrella.
Figure 2:
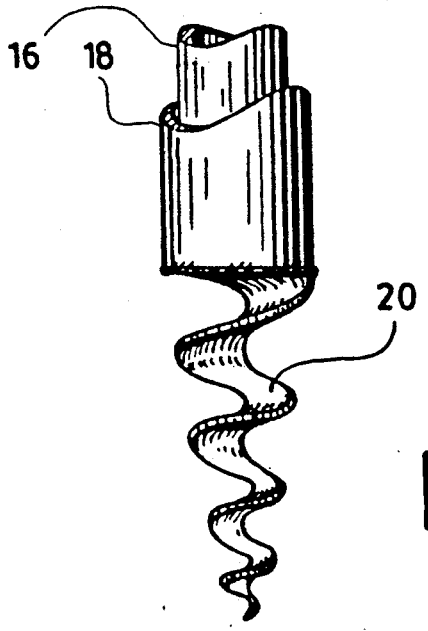
FIG. 2 is an enlarged perspective view of encircled portion 2 of FIG. 1.
Figure 3:
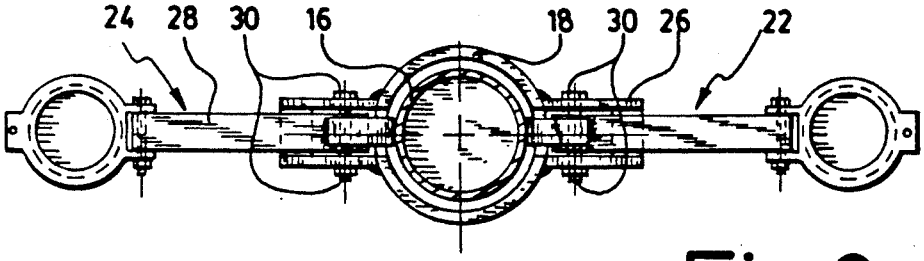
FIG. 3 is a cross-sectional view along line 3—3 of FIG. 1.

FIG. 1 illustrates an anchoring device 10, according to the invention, supporting a beach umbrella 12. The anchoring device 10 is secured into the ground 14 at a depth sufficiently long to stabilize the beach umbrella 12 according to the hardness of the ground, the size of the beach umbrella 12 and the prevailing wind.

The beach umbrella has an upright post 16 which is inserted into a hollow tubular member 18 at a depth sufficient to maintain the verticality of the post 16. The low part of the tubular member 18 extends downwardly with a tapered screw member 20 adapted to facilitate the introduction of the tubular member 18 into the ground 14. The screw member 20 has a tapered helicoidal shape when made of a rigid material such as steel but may have different shapes as explained later.

The tubular member 18 is provided with a pair of arm levers 22 and 24 extending laterally at the upper end of the member 18 for acting as handles and for facilitating the penetration of the hollow tubular member 18 into the ground 14, and more particularly for twisting the screw member 20. The two arm levers 22 and 24 are each made of an arm 26 rigidly secured to the member 18 and a lever 28 pivotally mounted on the arm 26 about an axle 30 so that the lever 28 can pivot along a vertical plane and reach a position 28' such as shown in dotted lines in FIG. 4. In the latter position, both levers 28 extend substantially parallel to the post 16.

Figure 6:
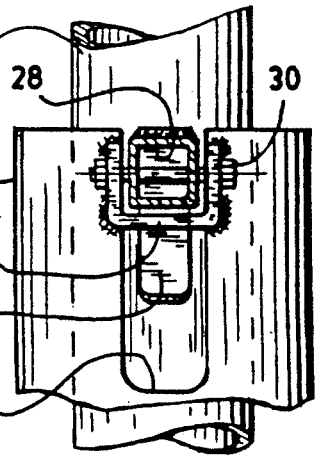
FIG. 6 is a side view along line 6—6 of FIG. 5.

The arm 26 is made of a generally U-shaped channel, as shown in FIG. 6, welded to the tubular member 18. The lever 28 has a cross-section substantially corresponding to the cross-section of the inner portion of the arm 26 so as to freely pivot about the axle 30. The lower face 32 of the U-shaped arms 26 stops the levers 28 its lower horizontal position. The lateral sides of each U-shaped arm 26 laterally support the lever 28 so that the latter can be rotated along a horizontal plane while pushing downwardly to allow the screw member 20 to penetrate into the ground 14.

Figure 4:
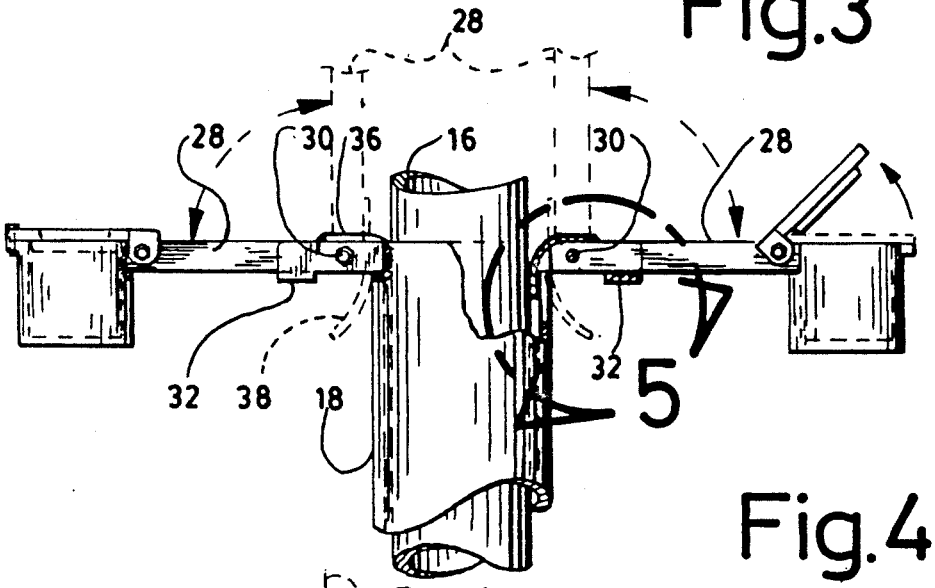
FIG. 4 is a side view of the upper portion of the anchoring device, as shown in FIGS. 1 and 3.
Figure 5:
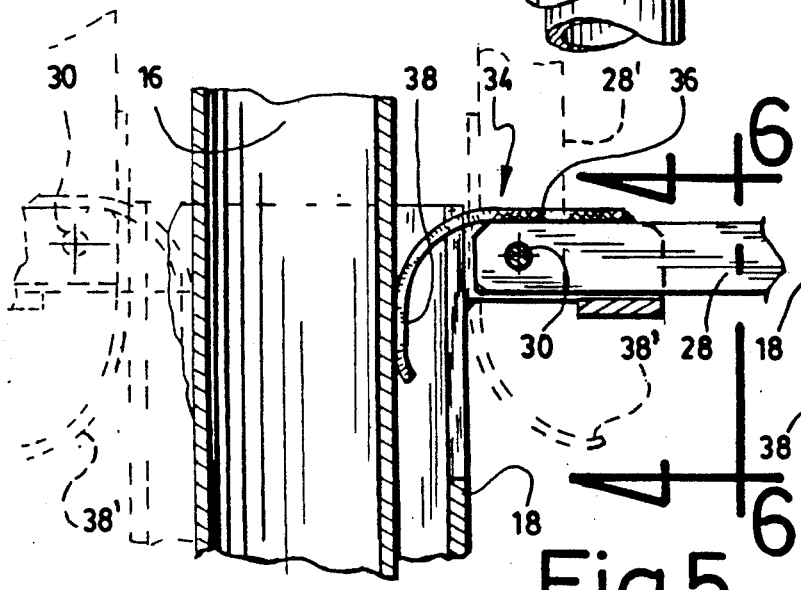
FIG. 5 is an enlarged view of the encircled portion 5 of FIG. 4.

Each arm lever 22 and 24 are provided with means to tighten the post inside the tubular member 18 so as to prevent it from vertically moving inside the tubular member 18. The post which is inserted into the tubular member 18 is generally cylindrical but does not necessarily have the same diameter. For this purpose, the inner diameter of the tubular member 18 exceeds the diameter of the inserted post which leaves a gap therebetween. The tightening of the post 16 is obtained by the motion of the levers 28 from a vertical position 28' to a horizontal position 28. To obtain this result, the lever 28 is provided with a curved leaf spring 34 having a portion welded to the top surface of the lever 28 as seen in FIGS. 4 and 5 and a portion 38 extending inside the tubular member 18. When the lever 28 is in a horizontal position, the vertical portion of the spring 34 firmly abuts against the side of the post 16 in order to substantially maintain the post 16 coaxial with the tubular member 18. This is due to the fact that both levers 28 are provided with similar spring leaves 34 and apply a similar pressure on two diametrically opposed sides of the post 16. The leaf spring generally displays a quarter of a circle.

In order to release the tightening effect of the leaf springs 34, and in particular, the portion 38 on the post 16, the levers 28 are pivoted upwardly which automatically spaces the portion 38 of the spring 34 from the post 16 and brings the portion 38 in the position 38' shown in dotted lines in FIGS. 4 and 5. To obtain this result, the portion 36 of the spring 34 is disposed at a closer distance from the axle 30 than the portion 38.

The leaf spring 34 is generally made of steel when the anchoring device is made of metal so that the portion 36 can be welded on the lever 28. Other alternatives for tightening the post are also contemplated and are particularly explained later when the anchoring device is generally made of plastic.

In order to facilitate the passage of the portion 38 of the spring 34 in the direction of the portion 38', a slot is provided in the tubular member 18 as well as through the lower face 32 of the U-shaped arm 26.

Figures 7, 8, 9:
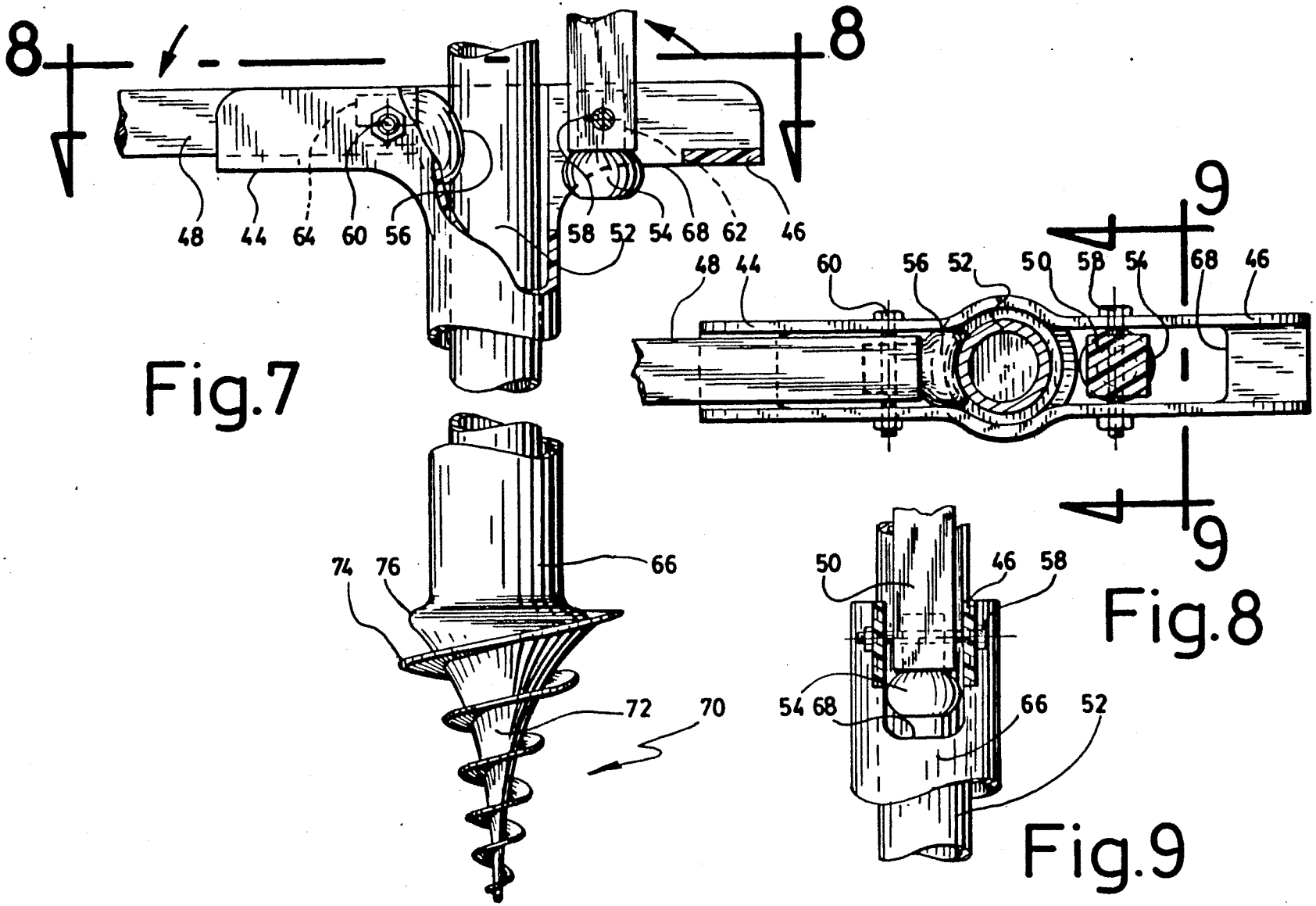
FIGS. 7–9 illustrate an alternative embodiment of the invention.

FIGS. 7, 8 and 9 illustrate an alternative embodiment of the invention. It is particularly interesting for an anchoring device made of plastic or when the post to be held upright may be stabilized by material such as plastic or rubber.

The anchoring device 42 has a pair of laterally extending arms 44 and 46 each supporting a lever 48 and 50 respectively. The arm 50 has a socket at the end adjacent the post 52 in which is secured a protruding ball-shaped member 54. The ball-shaped member 54 is essentially made of resilient material such as plastic or rubber and is adapted to frictionally engage the outer surface of the post 52 when the lever is in its horizontal position such as lever 48 holding ball-shaped member 56.

Both levers 48 and 50 ar articulated about an axle 60 and 58 respectively substantially in the same manner as explained in FIGS. 3–6 and are stopped in their horizontal position by the arms 44 and 46.

The ball-shaped member 54 and 56 have a cylindrical portion 62 and 64 which are introduced in the socket at the end of the levers 50 and 48 and retained therein by the axle 58 and 60.

When the lever 50 is moved from the vertical position to the horizontal position such as 48, the protuberant resilient member is squeezed against the post 52 to prevent the latter from vertical and lateral movements.

The lower part of the arm 46 and the adjacent vertical part of the tubular member 66 is provided with a slot 68 to allow the ball-shaped members 54 and 56 to move freely while the levers 50 and 48 are respectively tilted upwardly. For this purpose, the axles 58 and 60 are located at a suitable distance from the post 52 to bring the ball-shaped members 54 and 56 firmly in contact with the post 52 while the levers are in their horizontal position and to disengage the same ball-shaped members from the post when the levers are in their upright position.

Another modification of the present alternative embodiment is characterized by a tubular member 66 having a molded screw member 70. The screw member 70 has a central shaft 72 which is conical and preferably concave-conical. The cross-section of the conical shaft displays a concave line.

The shaft 72 is surrounded by a helicoidal blade 74 which tapers from top to bottom.

It is further a characteristic of the tubular member 66 to widen around its lower periphery to form a bead 76 so as to help preventing the tubular member 66 from being easily pulled out of the ground once inserted therein.

The dimension of the anchoring device may vary according to the post or the beach umbrella to be supported and the ground into which the screw member needs to be inserted. For supporting a beach umbrella on a seaside beach, a screw member having about 6 inches high and a 2 inch width is found satisfactory. The diameter of the post usually contemplated for beach umbrellas varies from $\frac{7}{8}$ from $1\frac{1}{8}$ inch in diameter. For soft ground, such as sand which is not too compacted, the width of the blade 74 may vary from $\frac{1}{4}$ inch to 1 inch.

Figure 10:
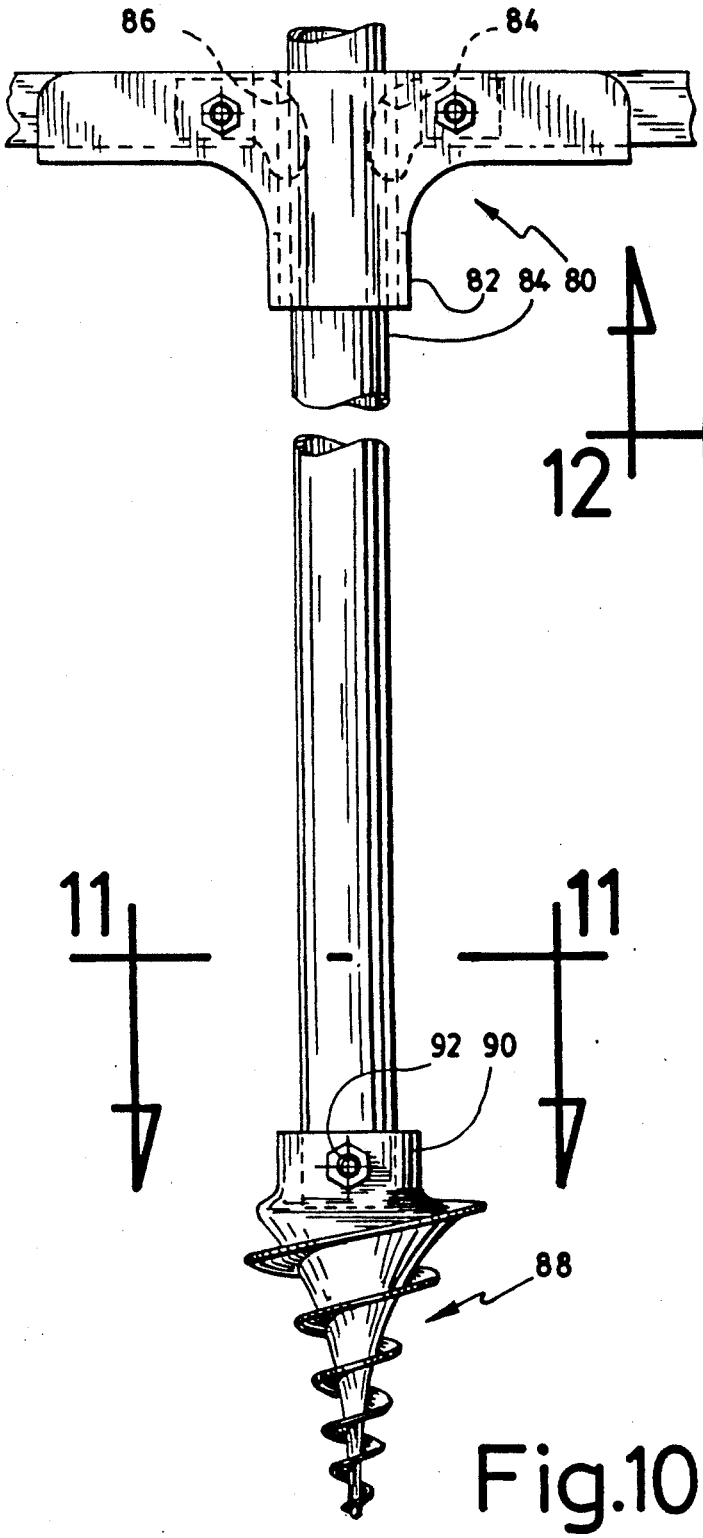
FIGS. 10–12 illustrate yet another alternative embodiment of the invention.
Figure 11:
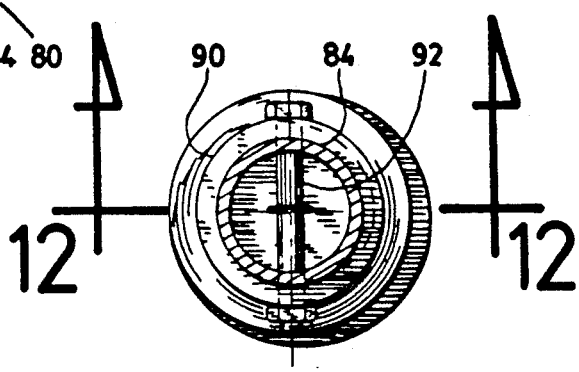
Figure 12:
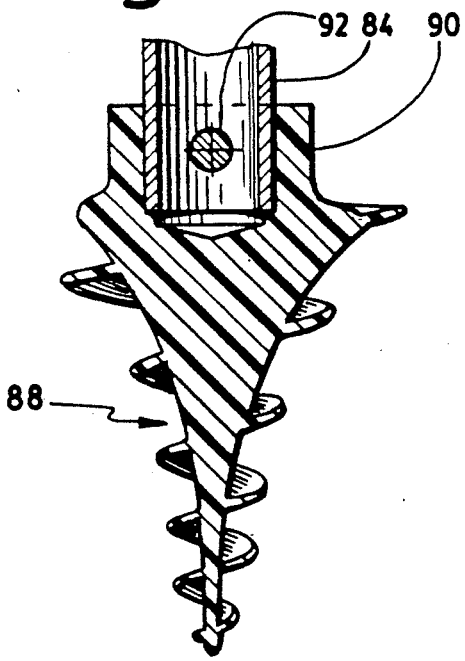

FIGS. 10–12 illustrate another alternative embodiment of the invention. The difference with the embodiment shown in FIG. 7 may be characterized by the fact that the tubular member between the arm levers and the screw member is partly removed. The arm levers and the screw member are two separate entities which are interrelated by a post such as a post of a beach umbrella. The arm lever 80 is essentially similar to the one shown in FIG. 7 and is connected to a short portion of a tubular member 82. The arm lever 80 is adapted to slide over the post 84 and be vertically fixed by a pair of ball-shaped members 84 and 86.

The screw member 88 is essentially similar to the screw member 70 shown in FIG. 7 and is connected to a portion 90 of the tubular member corresponding to the tubular member 56 shown in FIG. 7. The portion 90 is a sleeve adapted to receive the lower end of the post 84 and is provided with means to retain the post in the sleeve 90. For this purpose, the sleeve 90 is provided with a pair of diametrically opposed apertures to receive a bolt 92. The lower end of the post 84 is perforated with holes corresponding to the holes of the sleeve 90 for vertically and rotatably locking the screw member 88 to the post 84.

It should be understood that the sleeve 90 corresponds essentially to a recess in the upper end of the screw member 88.

In operation, the screw member 88 is sold as a kit with the arm lever 80 and are adapted to be installed on a post such as the post of a beach umbrella which needs to be secured into the ground. The arm lever 80 is slidden along the post 84 from the bottom and subsequently, the screw member 88 is fastened to the post 84 by the installation of the bolt 92 across both the post 84 and the sleeve 90. The arm lever 80 is adjusted at the desired height along the post 84 and is vertically fixed as described in FIGS. 7–14 by creating a resilient pressure with the ball-shaped members 84 and 86. The rotation of the arm lever 80 with the post drives the screw member 88 into the ground by applying a downward pressure on the lever arm 80 while the latter are rotated.

Although two arrangements have been described to tighten the post with the pivoting action of the arm levers, it should be understood that a variety of tuggle-action devices could be suitable for vertically retaining the arm lever to the post.

We claim:

1. An anchoring device for securing a post into the ground comprising:

a hollow tubular member opened at the upper end thereof, said tubular member adapted to vertically support a tubular post extending through said upper end, a screw member secured at the lower end of said tubular member, said screw member adapted to facilitate the penetration of the device into the ground, a handle member fixed adjacent the upper end of said tubular member and projecting sideways on said tubular member, said handle member comprising a pair of lever members diametrically disposed relative to said tubular member, said lever members being pivotally connected to said tubular member for pivoting in a vertical plane, means for stopping said lever members for pivoting in a vertical plane, said handle member adapted to rotate said tubular member and said screw member into the ground, means located at the upper end of said tubular member for tightening said post when the latter is mounted inside said tubular member, said tightening means comprising a curved leaf spring fixed to each of said lever members adjacent said tubular member and progressively projecting inside the latter, whereby upon a pivoting action of each of the lever members from a vertical position to a horizontal position, the leaf springs are adapted to tighten the post inside the tubular member.

2. An anchoring device as recited in claim 1, wherein said screw member has a tapering shank surrounded by a wide helicoidal propelling blade, the diameter of the upper part of said shank adjacent the tubular member forming a bead larger than the diameter of said tubular member forming a peripheral shoulder around the tubular member for retaining said device in the ground.

3. An anchoring device as recited in claim 2, wherein the tapering shank has a peripheral wall generated by a concave line.

4. An anchoring device as recited in claim 1, comprising a receptable secured at the outer end of each said lever members, a cover pivotally mounted over dais receptacle, said lever members adapted to pivotally moved upwardly toward each other in a direction away from said screw member, said covers facing each other for preventing them from unintentional opening when the lever members are in their upward position.

* * * * *